US005347663A

United States Patent [19]

Yost

[11] Patent Number: 5,347,663

[45] Date of Patent: Sep. 20, 1994

[54] CHILD SAFETY TOILET LID LOCK

[76] Inventor: Richard W. Yost, 20 Wall St., Hampton, N.H. 03842

[21] Appl. No.: 134,698

[22] Filed: Oct. 12, 1993

[51] Int. Cl.[5] ..... A47K 13/24

[52] U.S. Cl. ..... 4/253; 292/219

[58] Field of Search ..... 4/253, 661; 292/57, 292/60, 62, 219, 220, 195

[56] References Cited

U.S. PATENT DOCUMENTS

| | | | |
|---|---|---|---|
| 2,174,373 | 9/1939 | Baillod | 292/57 |
| 2,675,260 | 4/1954 | Frederick | 292/195 |
| 2,698,439 | 1/1955 | Bruckner | 4/253 |
| 3,431,004 | 3/1969 | Schell | 4/253 X |
| 4,658,447 | 4/1987 | Smith | 4/253 X |

*Primary Examiner*—Robert M. Fetsuga
*Attorney, Agent, or Firm*—Hugh E. Smith

[57] ABSTRACT

A toilet lid lock comprising a restraining arm removably coupled to a threaded rotatable lock rod mechanism. This mechanism has a first and second end. A repositioning handle and a lock bolt are located at the first end of the mechanism. A threaded portion of the second end of the mechanism receives a compression spring and an adjustable end cap. Two similarly shaped stanchions are further included in the Lid Lock, a first and second respectively, have one aperture each which passes through the stanchion for receiving the threaded rotatable lock rod mechanism. An additional aperture passes through the first stanchion for receiving the threaded rotatable lock rod mechanism lock bolt. The lock bolt is essentially a metal pin which is inserted or withdrawn from the aperture when the repositioning handle is rotated 90 degrees. Integral perpendicular flanges form the bases of the first and second stanchions with each flange having a plurality of screw holes passing through the flange for receiving mounting bolts.

5 Claims, 3 Drawing Sheets

CHILD SAFETY TOILET LID LOCK

BACKGROUND OF THE INVENTION

1. Field of the Invention

The present invention relates to a toilet lid lock and more particularly pertains to toilet lid locks which may be used to lock a toilet lid and thereby prevent the accidental drowning of youngsters.

2. Description of the Prior Art

Safety experts have long attempted to alert the public to an often overlooked tragic reality, that the home is the single most dangerous environment to which we are regularly exposed. Children are a particularly susceptible class of individual with respect to household accidents. With Drowning is one of the major causes of injury or death to children. Since 1973, over 300 children have drowned in household bathtubs, basins, buckets, and toilet bowls. Accordingly, inventors have sought to reduce the inherent risk of such items through employment of locking devices on toilet bowl lids and by utilizing other safety devices.

The use of toilet lid locks is known in the prior art. More specifically, toilet lid locks heretofore devised and utilized for the purpose of locking toilets are known to consist basically of familiar, expected and obvious structural configurations, notwithstanding the myriad of designs encompassed by the crowded prior art which have been developed for the fulfillment of countless objectives and requirements.

The present invention is directed to improving devices for toilet lid locks in a manner which is safe, secure, economical and aesthetically pleasing.

For example, U.S. Pat. No. 5,003,641 to Selman discloses a toilet lid safety lock comprising a counterweighted pivoting arm device with an automatic locking and unlocking mechanism.

U.S. Pat. No. 4,395,784 to Foster describes a toilet seat and lid safety lock comprising a lock-block with a spring-actuated hinge to restrain the toilet lid.

Another patent of interest is U.S. Pat. No. 4,724,551 to Gardner disclosing a toilet seat lid lock comprising a special hinge arm and locking base affixed to the toilet lid.

U.S. Pat. No. 4,524,470 to Grenell describes a toilet lid lock mechanism which comprises a control shoe mounted on the toilet lid and a lid control arm which extends from the control shoe.

Yet another patent of interest is U.S. Pat. No. 3,477,070 to Kimber disclosing a toilet lid lock comprising a strap mechanism for securing the toilet lid to the toilet bowl exterior.

Finally, U.S. Pat. No. 4,736,472 to Buckshaw describes an automatically relocking hinge mechanism affixed to the front of the toilet bowl for restraining the toilet lid.

The toilet lock mechanisms mentioned above, while sufficient for their intended usages, do not specifically address the requirements for a toilet lock to be used where toilet use is frequent and primarily by adults.

The present invention unlike the others above, has no internal or covert parts. The whole is accessible and easy to disassemble and clean as necessitated by modern hygiene requirements.

All the parts in the present invention are either corrosion resistant, or shrouded in soft plastic or both. This protects the toilet porcelain from scratches and rust, and reduces the likelihood of any pinches or cuts to the body from sharp edges. There is an absolute minimum of moving parts and a resultant ease of maintenance.

Another important aspect of the present invention is that the device is free and clear of the toilet lid when unlocked. This also saves wear and tear on the toilet.

Lastly, the spring tension and locking mechanism may be adjusted. This is beneficial because the locking mechanism can be adjusted to prohibit unsupervised use by a child, but can be set so that an infirm adult can unlock the toilet.

This adjustability brings about another benefit. Since the present invention may be adjusted to keep children out of the toilet, the unlocking mechanism need not be located in an hard-to-access location. It is located within easy reach of the user.

In this respect, the toilet lid lock according to the present invention substantially departs from the conventional concepts and designs of the prior art, and in so doing provides an apparatus primarily developed for the purpose of toilet lid locks used in environments where toilet use is predominantly by adults or under adult supervision.

Therefore, it can be appreciated that there exists a continuing need for new and improved toilet lid lock which can be easily used and cleaned. In this regard, the present invention substantially fulfills this need.

As illustrated by the background art, efforts are continuously being made in an attempt to devise an easy to use and clean toilet lid lock. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of toilet lid locks now present in the prior art, the present invention provides an improved toilet lid lock construction wherein the same can be utilized for easy installation, use, and cleaning in primarily adult-use environments. As such, the general purpose of the present invention, which will be described subsequently in greater detail, is to provide a new and improved toilet lid lock apparatus which has many of the advantages of the toilet lid locks mentioned heretofore and many novel features that result in toilet lid lock which is not anticipated, rendered obvious, suggested, or even implied by any of the prior art, either alone or in any combination thereof and which has none of the disadvantages of the prior art toilet lid locks.

The invention is defined by the appended claims with the specific embodiment shown in the attached drawings. For the purpose of summarizing the invention, the invention may be incorporated into a toilet lid lock. The toilet lid lock comprises a restraining arm of durable metal removably coupled to a threaded rotatable lock rod mechanism. This mechanism has a first and second end. A repositioning handle and a lock bolt is located at the first end of the mechanism. A threaded portion is located at the second end of the mechanism for receiving a compression spring and adjustable end cap. Two similarly shaped stanchions, a first and second respectively, have one aperture each which passes from exterior a first side of the stanchion wall to exterior a second side of the stanchion wall for receiving the threaded rotatable lock rod mechanism. An additional aperture passes from the first side of the first stanchion wall through the second side of the first stanchion wall for receiving the threaded rotatable lock rod mechanism lock bolt. The lock bolt is essentially a metal pin which is inserted or withdrawn from the aperture when the repositioning handle is rotated 90 degrees. Integral perpendicular flanges form the bases of the first and second stanchions with each flange having a plurality of screw holes passing from a first side of the flange to a second side of the flange for receiving mounting bolts.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved toilet lid safety Lock comprising a restraining arm of durable metal removably coupled to a threaded rotatable lock rod mechanism having a first and second end; a repositioning handle and a lock bolt at a first end of the threaded rotatable lock rod mechanism; a threaded portion at a second end of the threaded rotatable lock rod mechanism for receiving a compression spring and adjustable end cap; a first and second similarly shaped stanchion with one aperture each which passes exterior one side of the stanchion wall to exterior the other side of the stanchion for receiving the threaded rotatable lock rod mechanism; an additional aperture passing exterior one side of the first stanchion wall to exterior the other side of the first stanchion wall for receiving the threaded rotatable lock rod mechanism lock bolt; integral perpendicular flanges forming the bases of the first and second stanchions with each flange having a plurality of screw holes passing therethrough to the other side of the flange for receiving mounting bolts.

It is therefore an additional object of the present invention to provide a new and improved toilet lid lock which has all the advantages of the prior art toilet lid locks and none of the disadvantages.

It is another object of the present invention to provide a new and improved toilet lid lock which may be easily and efficiently manufactured and marketed.

It is a further object of the present invention to provide a new and improved toilet lid lock which is of a durable and reliable construction.

An even further object of the present invention is to provide a new and improved toilet lid Lock which is susceptible of a low cost of manufacture with regard to both materials and labor, and which accordingly is then susceptible of low prices of sale to the consuming public, thereby making such toilet lid locks economically available to the buying public.

Still yet another object of the present invention is to provide a new and improved toilet lid lock which provides in the apparatuses and methods of the prior art some of the advantages thereof, while simultaneously overcoming some of the disadvantages normally associated therewith.

Still another object of the present invention is to provide a new and improved toilet lid lock which has external parts only for simple installation, and disassembly and cleaning.

Yet another object of the present invention is to provide a new and improved toilet lid lock with an adjustable locking mechanism. Such a mechanism could be adjusted to be easy for adults to unlock, but difficult, if not impossible, for children to unlock.

Even still another object of the present invention is to provide a new and improved toilet lid lock which does not touch, or rest upon, the toilet lid when unlocked. This makes normal, unlocked operation easier for users and precludes any undue wear of the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
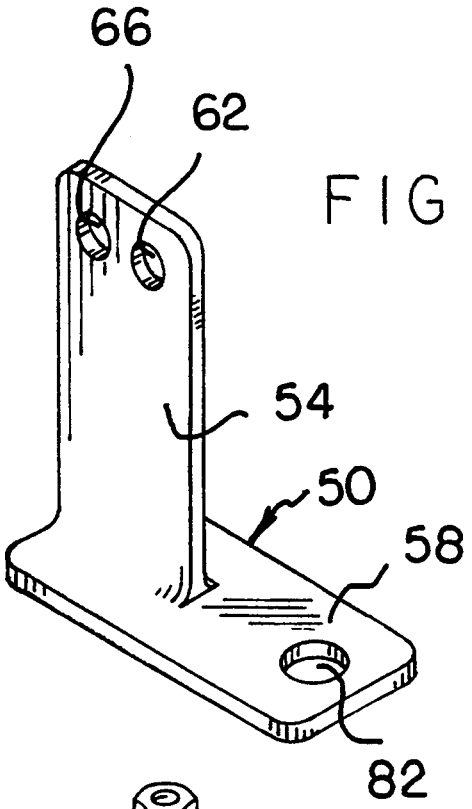
FIG. 1 is a perspective view of a first of two similarly shaped stanchions of the present invention.
Figure 2:
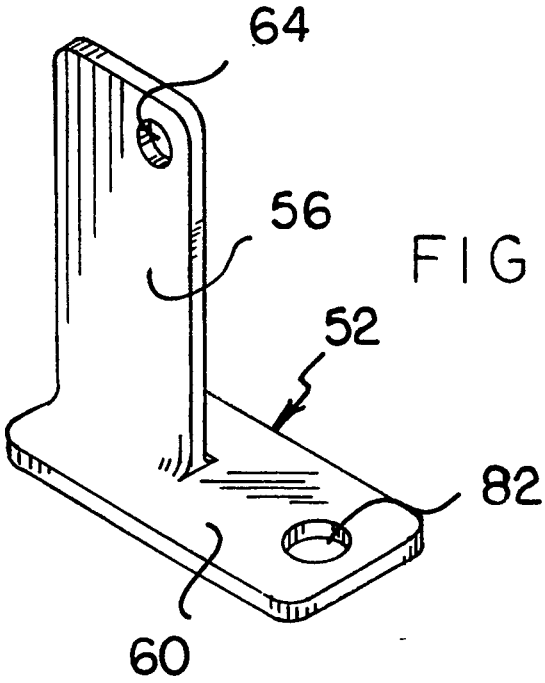
FIG. 2 is a perspective view of a second of the two similarly shaped stanchions of the present invention.
Figure 3:
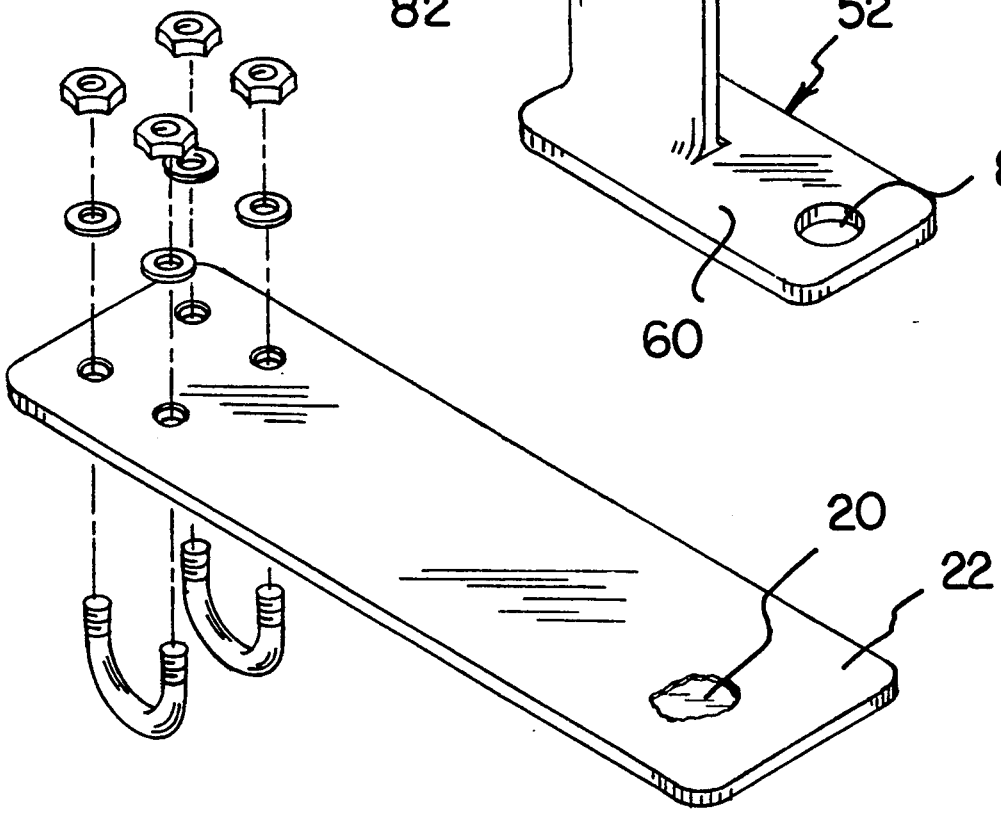
FIG. 3 is a perspective view of a restraining arm of the present invention.
Figures 4, 5:
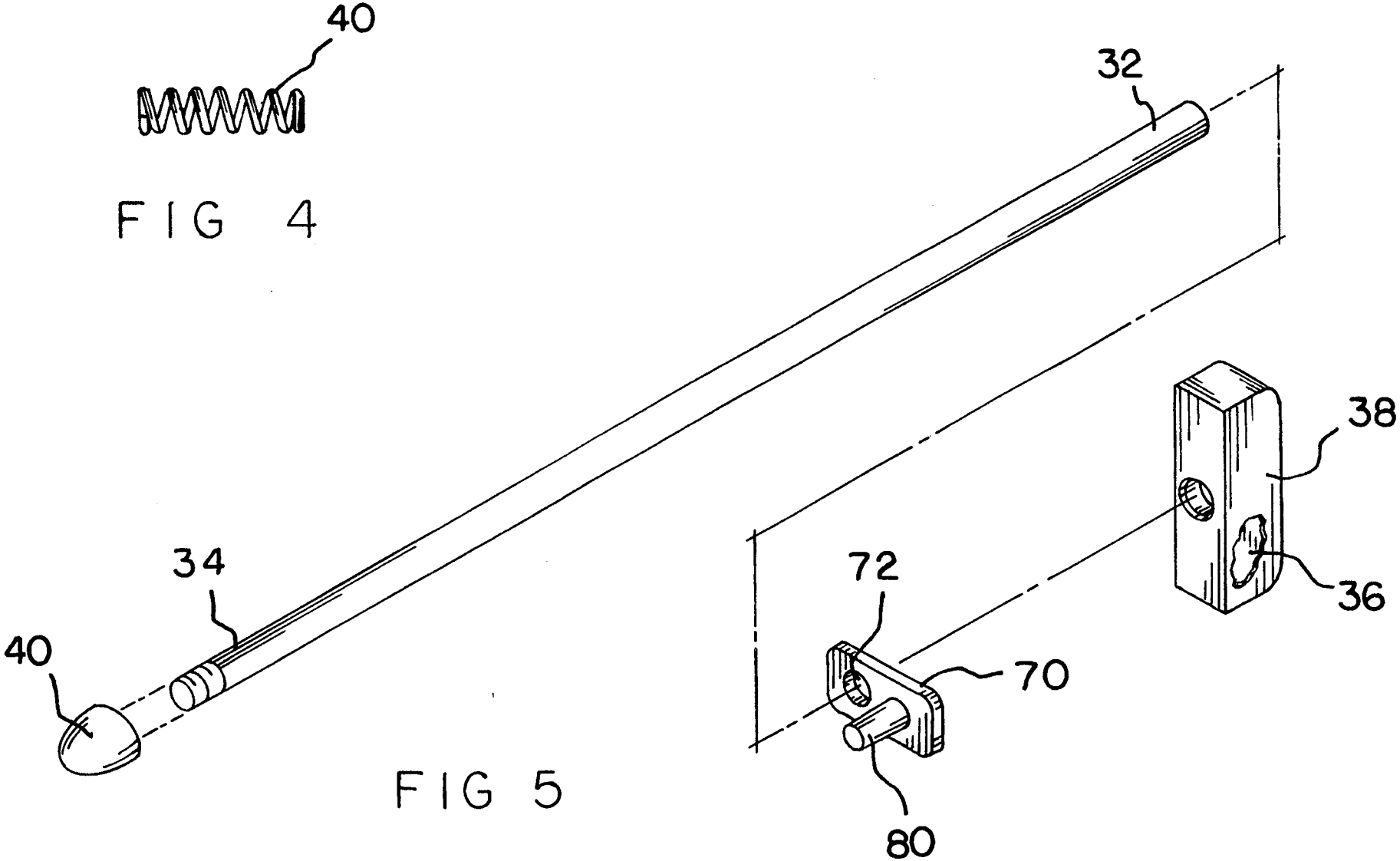
FIG. 4 is a perspective view of a compression spring of the present invention.
FIG. 5 is an exploded perspective view of a repositioning handle, lock bolt, threaded rotatable lock rod mechanism, and adjustable end cap of the present invention.
Figure 6:
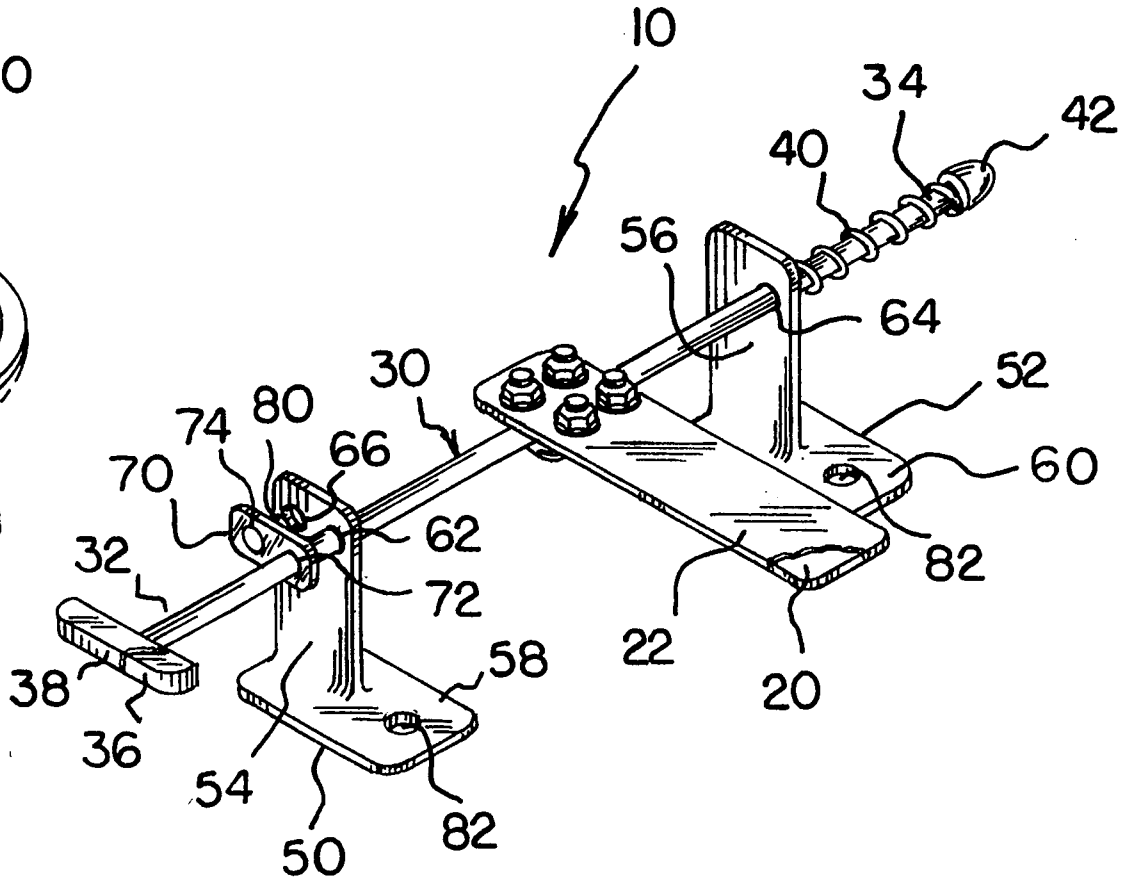
FIG. 6 is an a perspective view of the present invention.
Figure 7:
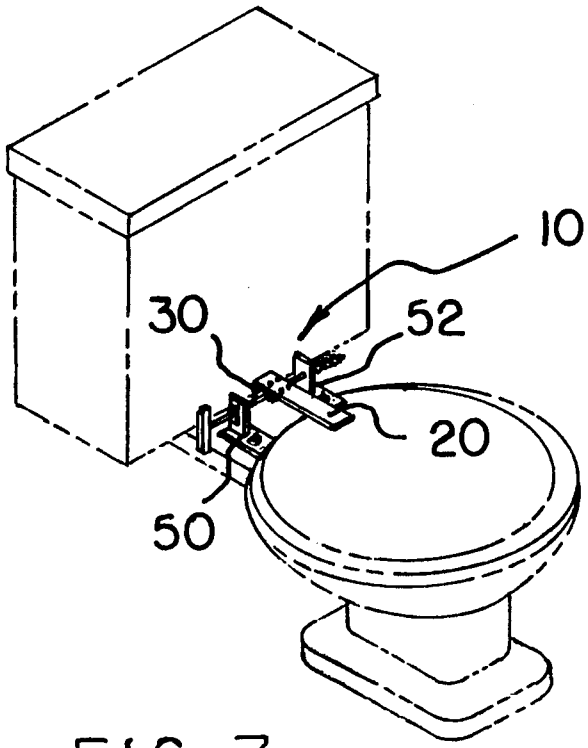
FIG. 7 is a perspective view of the present invention installed on a typical toilet.

With reference now to the drawings, and in particular to FIGS. 6 and 7 thereof, a new and improved toilet lid lock embodying the principles and concepts of the present invention and generally designated by the reference numeral 10 will be described.

From an overview standpoint, the toilet lid lock 10 is adapted for use with toilets, which by nature of the liquid contained therein pose a safety hazard to small children. See FIGS. 6 and 7.

More specifically, the toilet lid lock comprises a restraining arm 20 which is removably coupled by a pair of U-bolt connectors to a threaded rotatable lock rod mechanism 30 having a first end 32 and a second end 34. The restraining arm is a durable metal rectangular bar enshrouded in dye-accepting soft plastic 22 which can be manufactured to assume commonly employed colors of toilet porcelain. The plastic shroud on the restraining arm protects the arm from corrosion, the toilet porcelain from scratches, and the user of the device from contacting the restraining arm metal. The restraining arm 20 acts as a non-abrasive stop to prevent lifting of the toilet lid when the threaded rotatable lock rod mechanism is in the locked position. A feature is that the invention does not contact or rely on the toilet lid for supporting the lid lock, add any weight to the toilet lid, or interfere with the use of the toilet when in the optional unlocked position.

At the first end 32 of the threaded rotatable lock rod mechanism 30 is a repositioning handle 36. The repositioning handle is enshrouded in dye-accepting soft plastic 38 which can be manufactured to assume the commonly used colors of toilet porcelain. The soft plastic protects the repositioning handle from corrosion, and the provides a firm, comfortable grip for the user of the device. The size and shape of the repositioning handle make it easy to grasp and manipulate when locking or unlocking the threaded rotatable lock rod mechanism. The handle is conveniently placed in an accessible and visible location for ease of operation and maintenance. As with all other components of the invention the invention comprises only external parts for ease of maintenance.

The threaded rotatable lock rod mechanism is locked or unlocked by pulling and rotating the repositioning handle 90 degrees clockwise or counterclockwise, respectively. The tensional forces required pull the lock rod mechanism to thereby unlock the locked toilet lid is controlled by a compression spring 40. The amount of forces imparted on the lock rod mechanism is adjusted by turning an adjustable end cap 42. The end cap is operably positioned at the second end of the threaded rotatable lock rod mechanism. Turning the adjustable end cap clockwise make it harder to pull the lock rod mechanism, likewise, turning the end cap counterclockwise allows for easier pulling of the lock rod mechanism. The optimum setting produces sufficient tension to render the toilet lid prohibitively difficult for young children to unlock, but renders it easy to unlock by an adult using a modicum of effort. As with all other components pertaining to this invention, the tension spring is non-corrosive and is readily accessible for disassembly and cleaning.

The threaded rotatable lock rod mechanism and restraining arm is supported by similarly shaped first and second stanchions 50 and 52. Each stanchions comprise an upstanding support member 54 and 56 and a base flange 58 and 60 orthogonal thereto. The stanchion support members 54 and 56 have a first aperture 62 and 64 which passes from one exterior a first side of the support member to exterior a second side of the support member for receiving the threaded rotatable lock rod mechanism.

The first stanchion support member has a second aperture 66 passing from the first side of the support member to exterior the second side of the support member for receiving a lock bolt 80. The lock is operatively coupled to the threaded rotatable lock rod mechanism lock. The lock bolt is a metal pin which effectively locks or unlocks the toilet lid when the threaded rotatable lock rod mechanism is rotated using the repositioning handle 36 and the lock bolt is either inserted into, or withdrawn from, the second aperture of the first stanchion, respectively. The lock bolt is coupled to the lock rod by a flange member 70. The flange member has a first aperture 72 for fixedly receiving the lock rod and a second aperture 74 for receiving and fixedly coupling the lock bolt.

Flanges 58 and 60 form a base for the stanchions. The flanges have a plurality of screw holes 82 passing from exterior one side of the flange to the exterior thereof. The screw holes enable mounting of the stanchions and toilet lid lock to the toilet using standard hardware and are positioned cooperable with mounting bolts for securing the toilet seat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. An improved toilet lid safety lock for use with a toilet seat and lid hingedly mounted to a toilet through a pair of holes, said toilet lid safety lock comprising:

a restraining arm of durable metal removably coupled to a threaded rotatable lock rod mechanism having a first and a threaded second end;

a repositioning handle coupled to the first end of the threaded rotatable lock rod mechanism;

an adjustable end cap operatively coupled to the threaded second end of the lock rod mechanism;

a first and second similarly shaped stanchion each respectively positioned intermediate the first and second ends of the lock rod mechanism and the restraining arm, each stanchion comprising an upstanding support member and a base flange orthogonal thereto, each of the support members having one aperture extending therethrough, said apertures being substantially coaxial for receiving the threaded rotatable lock rod mechanism;

a compression spring positioned about the lock rod mechanism intermediate and engaging the adjustable end cap and upstanding support member of the second stanchion;

an additional aperture in the first stanchion upstanding support member passing therethrough;

a flange member positioned about the lock rod mechanism intermediate the first end thereof and the first stanchion member, the flange member having an aperture extending therethrough and further including a lock bolt positioned therein for being positioned within the additional aperture for precluding movement of the toilet lid;

each stanchion base flange including at least one aperture extending therethrough the base apertures cooperatively positioned with the mounting holes of the toilet seat and lid for coupling the toilet lid safety lock to the toilet.

2. The improved toilet lid safety lock of claim 1 wherein the restraining arm is coated with soft dye-accepting rubber for matching commonly available toilet surface coloration, protect against corrosion, and prevent scratching of the toilet surfaces.

3. The improved toilet lid safety lock of claim 1 wherein the repositioning handle of the threaded rotatable lock rod is coated with soft dye-accepting rubber to match commonly available toilet finishes, protect against corrosion, and provide a firm grip for the user.

4. The improved toilet lid safety lock of claim 1 wherein the compression spring is adjusted by turning the adjustable end cap to vary the amount of force.

5. The improved toilet lid safety lock of claim wherein the stanchions are mounted with the toilet seat and lid using existing hardware commonly supplied with the toilet.

* * * * *